US005449171A

United States Patent [19]

Makhoulian

[11] Patent Number: 5,449,171

[45] Date of Patent: Sep. 12, 1995

[54] MINIATURE GOLFER

[76] Inventor: Boghos Makhoulian, 30066 Cadigan Ct., Farmington Hills, Mich. 48334

[21] Appl. No.: 221,664

[22] Filed: May 31, 1994

[51] Int. Cl.[6] ..... A63F 7/06

[52] U.S. Cl. ..... 273/87.4; 446/336

[58] Field of Search ..... 446/333–336; 273/87.4, 87.2, 129, 129 W, 129 V

[56] References Cited

U.S. PATENT DOCUMENTS

| | | | |
|---|---|---|---|
| 750,134 | 1/1904 | Vaile | 446/336 X |
| 1,552,536 | 9/1925 | Blevins et al. | 273/87.4 |
| 2,222,499 | 11/1940 | Byrd | 273/129 |
| 3,503,613 | 3/1970 | Caya | 273/87.4 |
| 3,911,616 | 10/1975 | Pelfrey | 446/333 |
| 4,279,419 | 7/1981 | Barnes et al. | 273/87.4 |
| 4,738,649 | 4/1988 | Delli Bovi et al. | 446/336 |

FOREIGN PATENT DOCUMENTS

| | | | |
|---|---|---|---|
| 1266871 | 3/1972 | United Kingdom | 273/87.4 |

*Primary Examiner*—Mickey Yu
*Attorney, Agent, or Firm*—Andrew E. Pierce

[57] ABSTRACT

A simulated miniature standing golfing figure having pivotably attached upper and lower body parts and fixed arms extending forwardly and downwardly terminating in hands holding a golf club shaft. The golf club shaft is integrally connected to the hands so that upon clockwise rotation of the upper part of the body into a position in which the golf club shaft is upwardly directed, the upper part of the body of the figure is held by ratchet teeth against a ratchet teeth engaging a rod. This rod is spring actuated into an engaging position against the ratchet teeth. Upon release, spring action forces rotation of the upper portion of the body of the figure in a counter-clockwise direction so as to move the shaft of the golf club to a position in which it will hit a miniature golf ball.

3 Claims, 1 Drawing Sheet

MINIATURE GOLFER

BACKGROUND OF THE INVENTION

1. Field of the Invention

This application relates to a simulated miniature standing golfer figure holding a miniature golf club which may be moved in a pendulum action through manual operation.

2. Description of Related Art

Simulated golfing figures in miniature are known from U.S. Pat. Nos. 2,222,499 and 3,503,613. In order to provide a simulated miniature figure which will achieve a golf swing of the classic type in the simulated golfer of U.S. Pat. No. 3,503,613, there is used a mechanism which is delicately balanced and subject to inoperability with rough handling, as would be expected for such a figure where it is in constant use or utilized primarily by children. It is an object of the present invention to provide a miniature simulated golfer having a mechanism of a more rugged nature which will allow rough handling and constant use without the same likelihood of failure resulting from such use.

SUMMARY OF THE INVENTION

The present invention is directed to a miniature simulated standing golfer figure having an internal mechanism for producing a pendulum movement of a golf club shaft held by the golfer. A further object of the invention is to achieve the swinging of a golf club by a simple and ruggedly designed mechanical mechanism. Another object of the invention is to obtain a swinging action of a golf club which consistently provides the same amount of force on a miniature golf ball when the golfer figure is manually cocked.

In operation, in one embodiment of the invention, the pivotably attached upper portion of the body is manually rotated so that the golf club is pointing upwardly. This is performed by rotating the upper part of the body having rigidly attached arms with hands joined forwardly of the body to the shaft of the golf club which is inserted between the hands. The lower part of the upper body contains radially positioned ratchet teeth or other cam means which engage a rod engaging means positioned in the lower part of the body, said rod engaging means being coiled compression spring actuated so as force engagement with said ratchet teeth and said upper body having coiled torsion spring biasing means forcing the upper body to rotate about a central axis shaft so as to swing the golf club in a downward direction upon release of the rod engaging means. The rod engaging means can be retracted manually by withdrawing a cable attached to the lower portion thereof. The cable connected to said rod engaging means is mounted inside a coaxial tubular element which is led through the lower body of the figure and exits near the bottom thereof.

DESCRIPTION OF THE PREFERRED EMBODIMENTS

Figure 1:
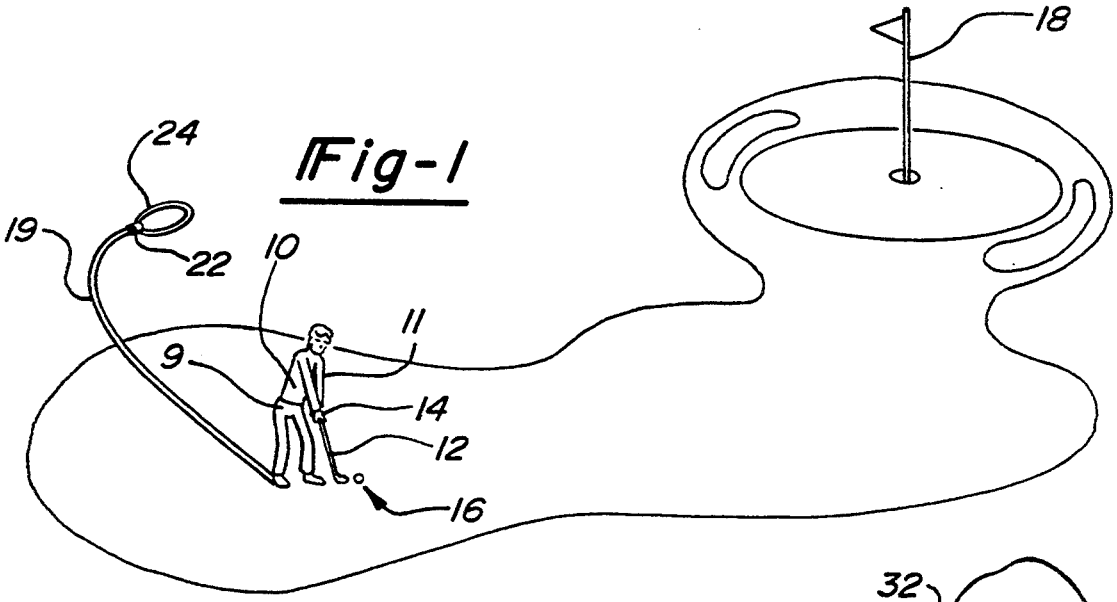
FIG. 1 illustrates the operation of a simulated miniature golfer in a game in which a miniature golf ball is hit by the simulated golfer in the direction of a golf hole marker.

FIG. 1 shows a standing miniature golfer having an upper body 10 and a lower body 9. Fixed arms 11 converge towards each other so that the two hands 14 are overlapping around golf club shaft 12. A rotational mechanism inside lower body 9 and upper body 10 is actuated through a flexible line 19 by manual movement of ring 24 away from coaxial cable stop 22. A game of golf is played by hitting golf ball 16 toward golf hole marker 18.

Figure 2:
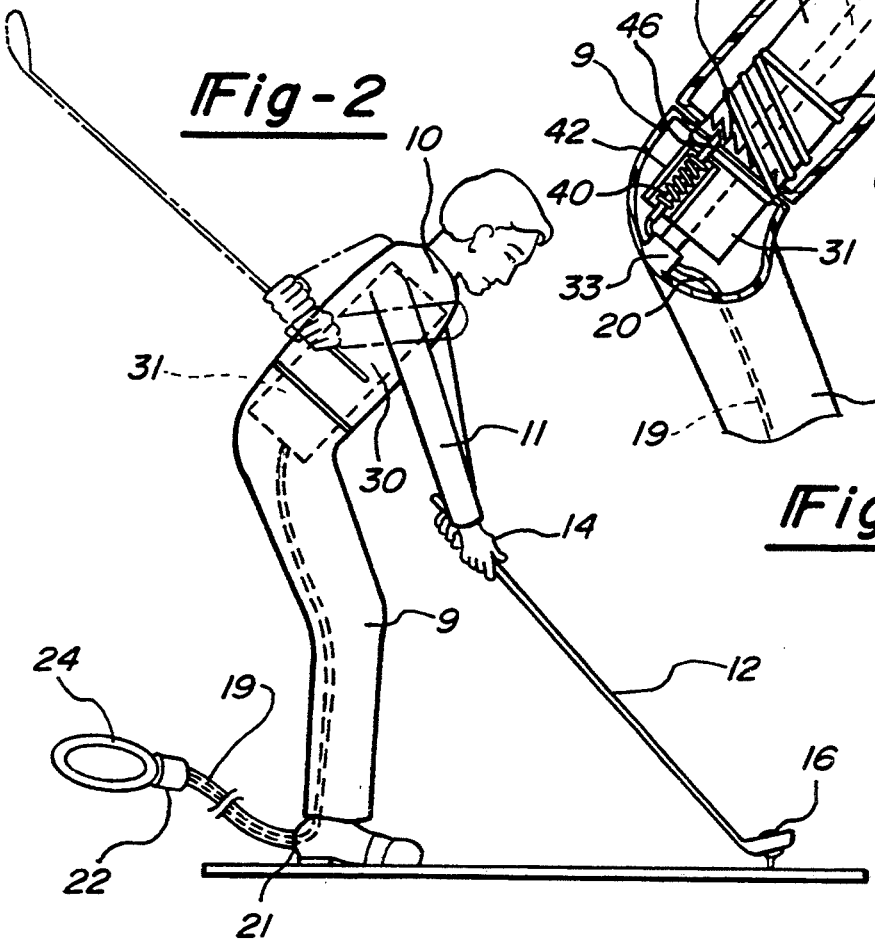
FIG. 2 illustrates both a cocked position and position striking a golf ball of one embodiment of the simulated golfer. The cocked position is shown in dashed lines. Movement of the upper body in a counter-clockwise direction permits the simulated miniature golfer to hit a miniature golf ball.
Figure 3:
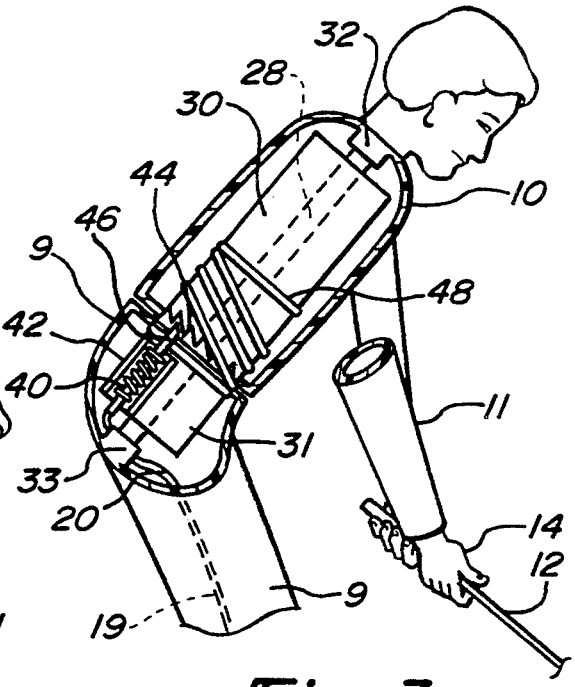
FIG. 3 is a cut away view showing the rotational mechanism of the simulated miniature golfer.

FIG. 2 illustrates one embodiment of the miniature golfer of the invention. An upper barrel 30 and a lower barrel 31 are pivotably mounted on rod 28, respectively, within upper body 10 and lower body 9 and integrally attached, respectively to upper body 10 and lower body 9 as shown in FIG. 3. Collars 32 and 33, shown on FIG. 3, prevent separation of upper body 10 from lower body 9. Flexible line 19 passes through lower body 9 and exits at the base thereof at 21.

FIG. 3, which is a cut away view in which portions of the upper body 10 and lower body 9 are removed to show internal parts. FIG. 3, illustrates more particularly the radially positioned ratchet teeth 44 on the lower part of upper barrel 30. The ratchet teeth engaging rod means 46 positioned on the upper part of lower barrel 31 and contained in recess 42 is forced into engagement with ratchet teeth 44 by coil spring 40. Coiled torsion spring 48 forces upper body 10 to rotate counter-clockwise from a position in which golf club shaft 12 is pointing upwardly.

Cable 20 inside flexible line 19 is attached to rod 46. Flexible line 19 passes through the lower body 9. Movement of the cable manually through flexible line 19 withdraws rod 46 from engagement in ratchet teeth 44 so as to permit coiled torsion spring 48 to rotate the upper body 10 counter-clockwise so as to move shaft 12 of the golf club from an upwardly extending position to a downwardly extending position so as to hit miniature golf ball 16.

In operation, the upper portion of the body 10 of the miniature simulated golfer is placed in an attack position such that the shaft 12 of the golf club is pointing upwardly. This is done by manually rotating upper body 10 clockwise. Ratchet teeth 44 engage rod 46 so as to hold the upper portion 10 of the miniature golfer figure in this attack position pending withdrawal of ratchet teeth engaging rod means 46 from engagement with ratchet teeth 44. Manual release to hit the golf ball results upon partial withdrawal of cable 20 within flexible line 19. Upon withdrawal from engagement of rod 46, upper body 10 rotates counter-clockwise under the urging of coiled torsion spring 48 so long as rod 46 is kept withdrawn and out of contact with ratchet teeth 44. Upon manual release of rod 46 by withdrawal of cable 20, engaging rod 46 disengages from ratchet teeth 44 and coiled torsion spring 48 rotates upper body 10 counter-clockwise so as to move the golf club shaft 12 from an upwardly facing position to a downwardly facing position and so as to hit the miniature golf ball 16 in the desired direction.

While ratchet teeth 44 are, preferably, radially located on the circumference of the lower end of upper barrel 30, these teeth can be located more centrally on the lower end of barrel and achieve the same result. Similarly, while it is preferable that rod 46, together with actuating spring 40 in chamber 42 be located near the circumference of the upper end of barrel 31, this assembly can be more centrally located on the upper end of barrel 31 and achieve the same mechanical effect with the proviso that the pivotal attachment of upper barrel 30 and lower barrel 31 on rod 28 provides no restriction in the location of the actuating mechanism. In the embodiment of the invention shown in the figures, counter-clockwise movement occurs upon release of the miniature golfer from a cocked position. One skilled in this art will recognize that the miniature golfer can be caused to move in a clockwise direction by appropriate modification including changing the attachment position of coiled torsion spring 48 so as to cause it to exert force in the opposite direction subsequent to release of the golfer from the cocked position. Accordingly, it will be understood that it is intended to cover all changes and modifications of the invention disclosed herein for the purposes of illustration which do not constitute departures from the spirit and scope of the invention.

What is claimed is:

1. A miniature golfer comprising:

A. a standing figure having rotatably movable upper and lower body parts, said body parts pivotably attached by means of a centrally located axis shaft and located within said upper and lower body parts, respectively, an upper and a lower barrel said upper barrel integral with said upper body part and said lower barrel integral with said lower body part;

B. torsion coil spring biasing means on said upper barrel forcing rotation of said upper barrel and said upper body part about said axis shaft;

C. circumferentially positioned, engaging means on the lower end of said upper barrel;

D. coil compression spring actuated engaging means on the upper end of said lower barrel to force engagement against circumferentially positioned engaging means on the lower end of said upper barrel; and E. a release cable connected to said spring actuated engaging means.

2. The miniature golfer of claim 1 wherein said release cable exits the lower part of said lower body and said upper barrel engaging means consists of ratchet teeth.

3. The miniature golfer of claim 2 wherein said release cable consists of a flexible element mounted over said cable and said lower barrel engaging means is a ratchet tooth engaging rod.

* * * * *